US007367536B1

(12) United States Patent
Anderson et al.

(10) Patent No.: US 7,367,536 B1
(45) Date of Patent: May 6, 2008

(54) MOUNTING BRACKET FOR A COVERING FOR ARCHITECTURAL OPENINGS

(75) Inventors: Richard N. Anderson, Whitesville, KY (US); Eugene W. Thompson, Maceo, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 11/468,412

(22) Filed: Aug. 30, 2006

Related U.S. Application Data

(60) Provisional application No. 60/714,149, filed on Sep. 2, 2005.

(51) Int. Cl.
*A47H 1/14* (2006.01)

(52) U.S. Cl. ..... 248/251; 248/222.11; 248/254; 160/902

(58) Field of Classification Search ..... 248/251, 248/252, 254, 262, 300, 222.11, 222.12; 160/178.1, 902
See application file for complete search history.

(56) References Cited

U.S. PATENT DOCUMENTS

| | | | | | |
|---|---|---|---|---|---|
| 2,293,662 | A | * | 8/1942 | Richardson | 160/19 |
| 2,524,711 | A | * | 10/1950 | Nelson | 248/264 |
| 2,568,001 | A | * | 9/1951 | Harris | 248/264 |
| 2,698,727 | A | * | 1/1955 | Rutledge | 248/264 |
| 3,636,342 | A | * | 1/1972 | Blount | 248/310 |
| 4,438,897 | A | * | 3/1984 | Vecchiarelli | 248/544 |
| 4,607,818 | A | * | 8/1986 | Georgopoulos | 248/544 |

OTHER PUBLICATIONS

Drawing of a Hunter Douglas bracket in the market prior to Aug. 30, 2005.

* cited by examiner

*Primary Examiner*—Korie H. Chan
(74) *Attorney, Agent, or Firm*—Theresa Fritz Camoriano; Guillermo Camoriano; Camoriano and Associate

(57) ABSTRACT

A mounting bracket for mounting a head rail for a window covering includes a rigid housing and a flexible clip.

7 Claims, 16 Drawing Sheets

MOUNTING BRACKET FOR A COVERING FOR ARCHITECTURAL OPENINGS

This application claims priority from U.S. Provisional Application S/N 60/714,149 filed Sep. 2, 2005, which is hereby incorporated by reference.

BACKGROUND

The present invention relates to a mounting bracket for mounting the top rail (or head rail) of a covering for an architectural opening, such as a window covering. Typical prior art mounting brackets are made of a single-piece of spring steel that is powder coated. This single piece bracket is a complex metal piece in order to provide the capabilities of releasably securing the head rail to the bracket as well as mounting the bracket to a wall or frame. As a result, each mounting bracket is relatively expensive to manufacture. Furthermore, the single-piece, spring steel construction results in a bracket with too much "give" or flex, and it often results in fatigue failure of the bracket due to excessive flexing.

SUMMARY

In one embodiment of a mounting bracket made in accordance with the invention, the mounting bracket is made in two pieces. The first piece is a rigid, molded plastic part (housing) with through openings for mounting it to a vertical wall, a horizontal wall, or both. This plastic part has forward and rear projections which engage a channel on the top surface of the head rail. That embodiment also includes a second piece, which is a simple, flexible, spring steel part (metal clip) which slides onto the plastic housing. The clip is substantially more flexible and elastic than the housing. This metal clip has a rearwardly facing projection which engages a shoulder on the plastic housing to prevent the metal clip from falling out, especially when the head rail is mounted to the bracket. The metal clip also has two forwardly facing projections which engage a lip on the head rail when the head rail is mounted to the bracket. The metal clip flexes momentarily during the head rail mounting process to allow the channel on top of the head rail to engage the rear projection on the plastic housing, and then the metal clip flexes back to lock the head rail in place.

To remove the head rail from the bracket, one only needs to flex the metal clip back far enough to allow the lip on the head rail to clear the two forwardly facing projections on the metal clip. This allows pivoting of the head rail down and away from the bracket to release it from the plastic housing as well.

In another embodiment, the mounting bracket is once again a two-piece bracket including a rigid, molded plastic part (housing) with through openings for mounting it to a vertical wall, a horizontal wall, or both. This plastic housing has forward and rear projections which engage a channel on the top surface of the head rail. This embodiments also includes a flexible, spring steel part (metal clip) which slides over a part of the plastic housing to prevent the metal clip from falling out, especially when the head rail is mounted to the bracket. The metal clip also has two forwardly facing projections which engage a lip on the head rail when the head rail is mounted to the bracket. The metal clip flexes momentarily during the head rail mounting process to allow the channel on top of the head rail to engage the rear projection on the plastic housing, and then the metal clip flexes back to lock the head rail in place.

It may be noted that the designations of a first, rigid plastic piece and a second, flexible metal piece are used to described the depicted embodiments only, and is not intended to imply or specify the materials of construction. In fact, the rigid housing could be made of any number of materials including cast or machined metal or plastic-like materials. Likewise, the flexible clip could also be made of any number of materials such as spring steel or even plastic.

In the embodiments disclosed below, the design of the mounting bracket is such that the flexible metal clip may be readily mounted to, or removed from, the plastic housing as long as the head rail is not assembled to the bracket. However, mounting the head rail to the bracket locks the flexible metal clip to the plastic housing such that the disassembly of the bracket can not proceed unless some part of the bracket (either the metal clip, or the plastic housing, or both) is damaged or destroyed. Furthermore, the head rail itself is supported such that it is not allowed to fall unless some part of the bracket fails (except, of course, if the proper disassembly procedure is followed).

In yet another embodiment of a mounting bracket made in accordance with the invention, the mounting bracket is made in three pieces and is designed for carrying heavier cantilevered loads, as may be the case when mounting an extra-wide blind and/or a substantially heavy blind. The first two pieces are as described above. The third piece is a steel insert designed to work as a "hat" channel in order to increase the beam strength of the cantilevered portion of the mounting bracket. Of course, this insert piece need not be a steel piece, and it could be made from any number of materials, including plastic.

DESCRIPTION

Figure 1:
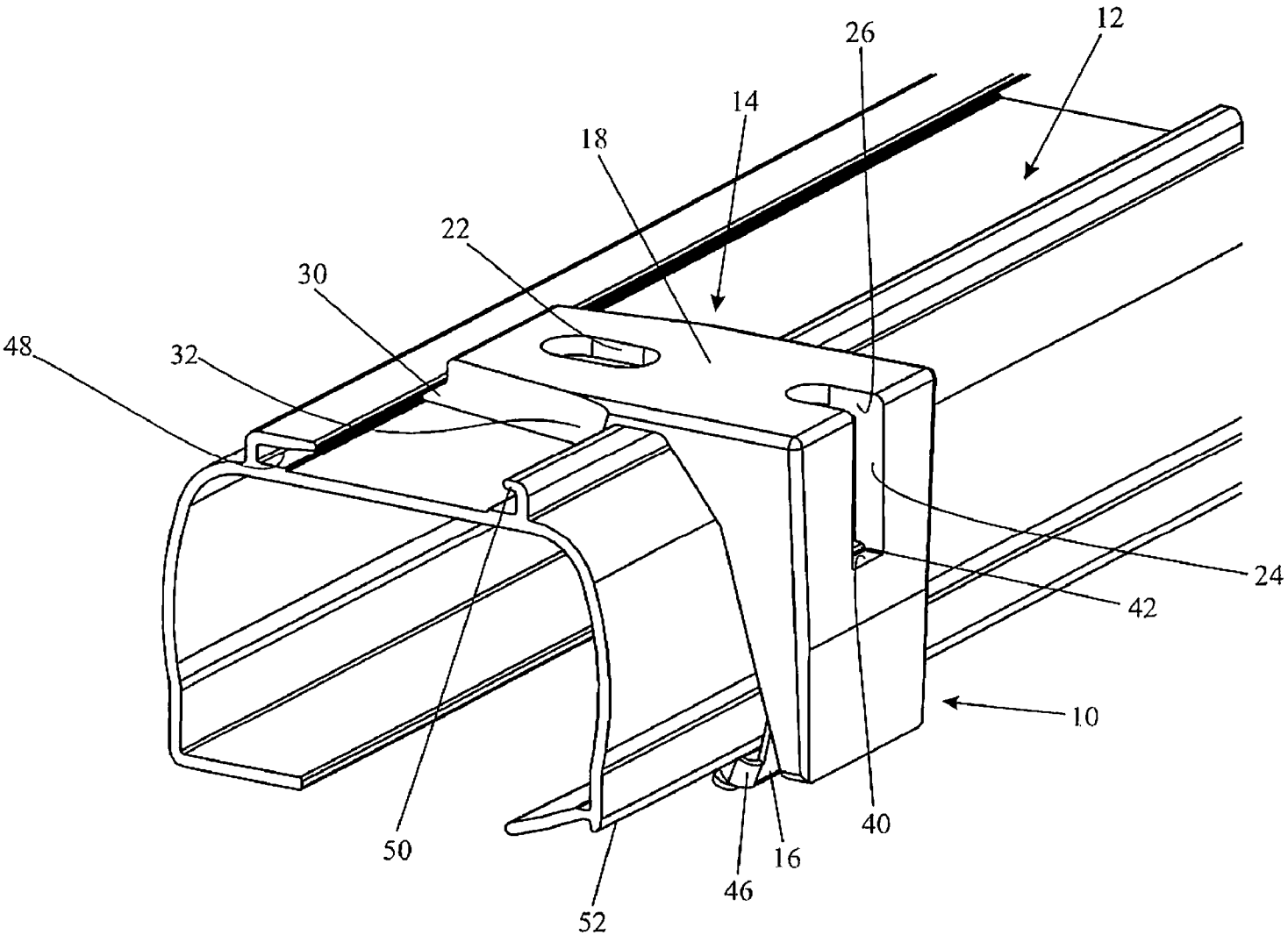
FIG. 1 is a broken away, perspective view of a head rail for a window covering using a first embodiment of a bracket made in accordance with the present invention.

FIGS. 1-10 show an example of a mounting bracket 10 made in accordance with the present invention. FIG. 1 shows a head rail 12 of a window covering (such as a window shade) mounted onto the mounting bracket 10, as will be explained in more detail below.

Figure 2:
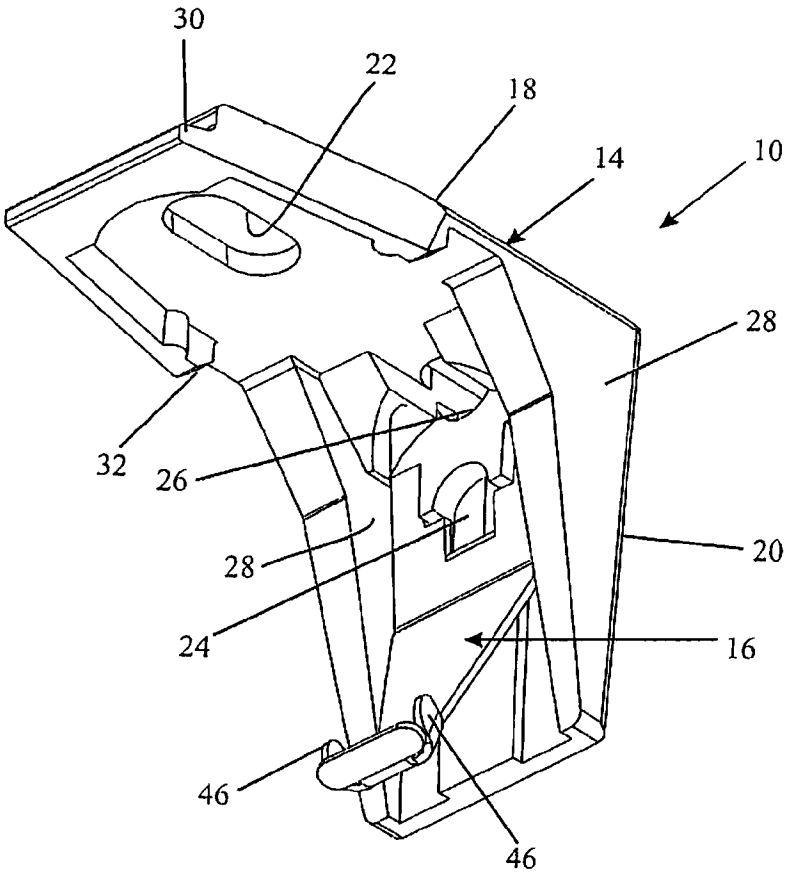
FIG. 2 is a perspective view of the inside of the mounting bracket of FIG. 1.

FIG. 2 is a perspective view of the bracket 10, which includes a body 14 and a flexible clip 16. In this example, the body 14 is a single-piece, molded plastic part, and the flexible clip 16 is a single-piece, spring steel part. The plastic body 14 can be made in a multi-cavity molding tool (which can mold several parts at once, as opposed to a single-cavity tool), which helps bring down the cost for each part. The metal clip 16 is stamped and bent from a single piece of spring steel. Practically the entire metal clip 16 is hidden from view once the head rail 12 is mounted to the bracket 10, so additional cosmetic finishes, such as powder coating, are not necessary for this part 16, also helping to bring down the cost for each bracket 10.

Referring to FIGS. 1, 3, 6, and 7, the body 14 is "L" shaped, with a horizontal leg 18 extending forwardly and a vertical leg 20 extending downwardly from the horizontal leg 18. The horizontal leg 18 defines a through opening 22, which may be used for securing the bracket 14 to a horizontal structure, such as the top of a window frame, using a screw, bolt, or other fastener (not shown). Similarly, the vertical leg 20 defines a through opening 24, which may be used for securing the bracket 14 to a vertical structure, such as the side of a window frame, using a screw, bolt, or other fastener (not shown). Finally, the intersection of these horizontal and vertical legs 18, 20 defines a through opening 26, which also may be used for securing the bracket 14 to a structure, using a screw, bolt, or other fastener (not shown). Gussets 28 on both sides of the bracket body 14 reinforce the connection between the horizontal and vertical legs 18, 20 to make the body 14 strong and relatively inflexible.

The horizontal leg 18 also defines a forwardly-projecting lip 30, as well as a rearwardly-facing shoulder 32, which are used to mount the head rail 12 to the bracket 10 as described in more detail below.

The vertical leg 20, on its inner surface adjacent its intersection with the horizontal leg 18, includes a short pair of tracks or rails 34, which define two elongated and vertically aligned, upwardly-directed gaps or slots 36 (See FIG. 7) which receive the vertical twin tines 38 of the metal part 16 as described in more detail below. The vertical leg 20 also defines an upwardly-facing shoulder 40 (See FIGS. 1 and 3), which acts as a stop for the horizontal, rearwardly facing projection 42 on the metal clip 16 (see FIG. 5), as is also described in more detail below.

Figure 3:
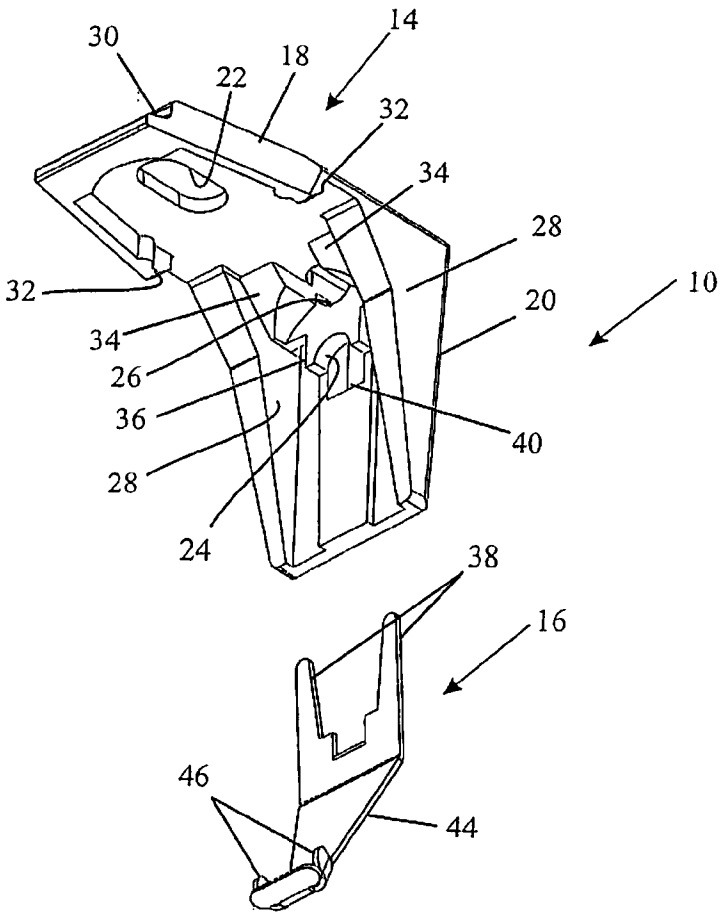
FIG. 3 is an exploded, perspective view of the bracket of FIG. 2.
Figure 5:
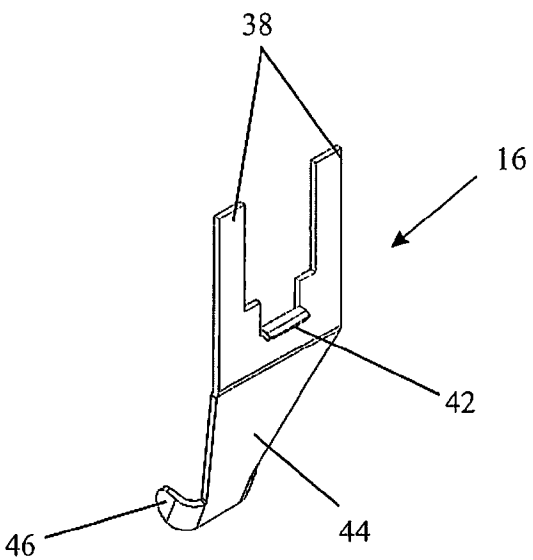
FIG. 5 is a perspective view of the metal piece shown in FIGS. 2-4.

Referring to FIGS. 3 and 5, the metal flexible clip 16 is "Y" shaped, with upwardly projecting twin forked tines 38, and a downwardly projecting leg 44 which is inclined at a forward angle from an imaginary vertical plane defined by the twin tines 38. Extending rearwardly from this imaginary vertical plane and at the base of the twin tines 38 is the substantially horizontal projection 42. This projection 42 engages the top of the shoulder 40 on the vertical leg 20 of the body 14 when the metal clip 16 is assembled to the body 14, so as to prevent the clip 16 from falling out of the body 14, as is explained in more detail below. At the bottom of the downwardly projecting leg 44 is a pair of ramped hooks 46 (See also FIGS. 8-10) which help secure the head rail 12 to the bracket 10 as described below.

Figure 4:
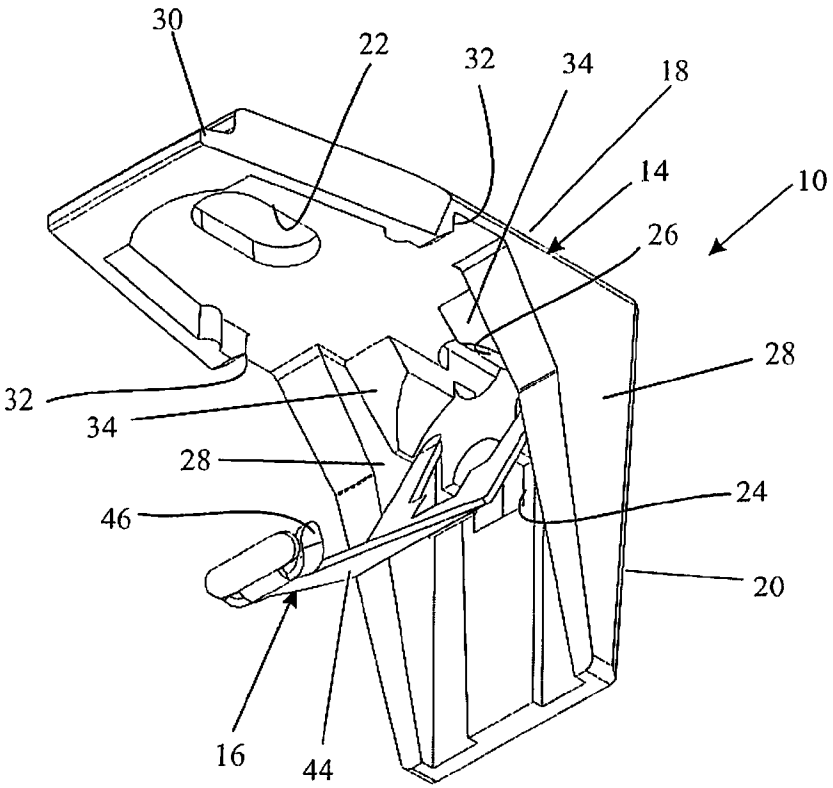
FIG. 4 is a perspective view of the bracket of FIG. 2, with the metal piece partially assembled onto the plastic piece.
Figure 7:
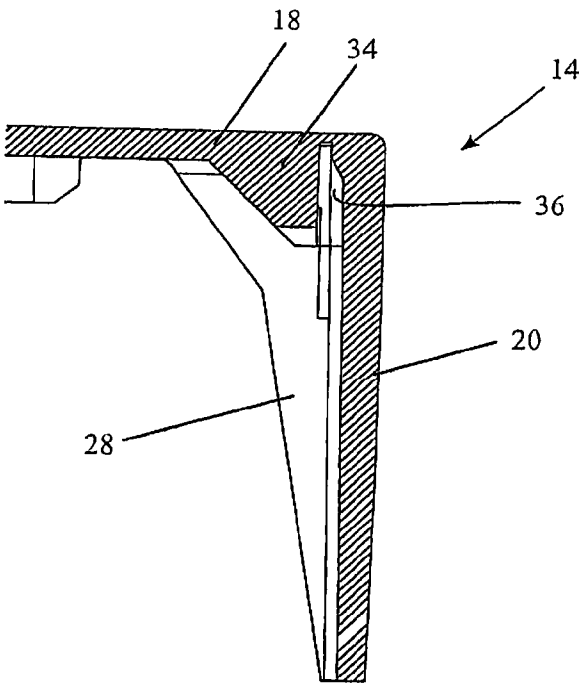
FIG. 7 is a sectional view along line 7-7 of FIG. 6.
Figure 6:
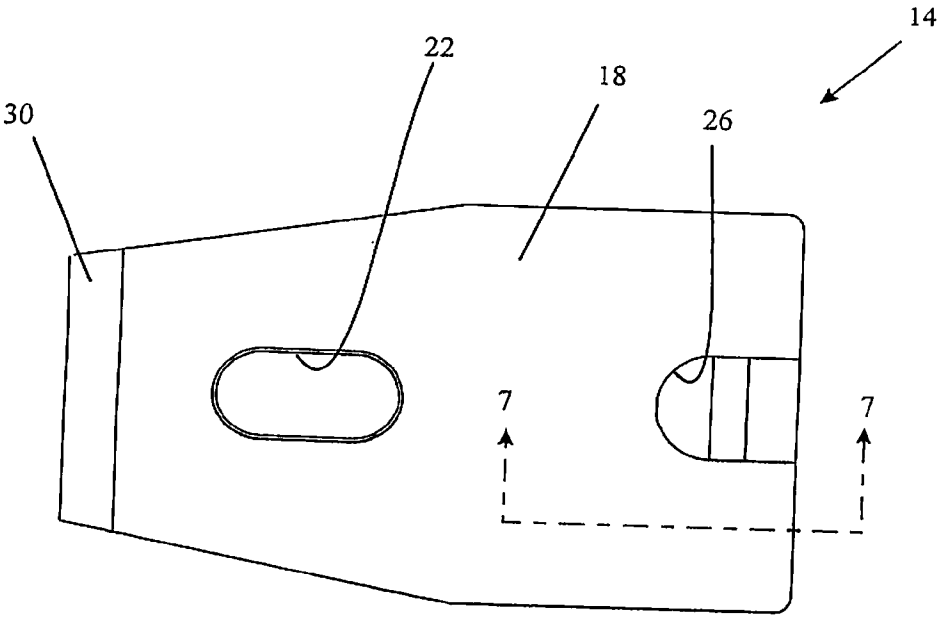
FIG. 6 is a plan view of the plastic part of the bracket of FIGS. 1-4.

Referring to FIGS. 3 and 4, the bracket 10 is assembled by lining up the twin tines 38 of the clip 16 with the rails 34 in the body 14. The twin tines 38 are inserted upwardly behind the rails 34 along the elongated gaps 36 (see FIG. 7). The clip 16 may be pulled forwardly to facilitate assembly by eliminating the interference of its rearward projection 42 with the vertical leg 20 of the body 14. Once the tines 38 are fully inserted behind the rails 34, the clip 16 is swung back toward the vertical leg 20 of the body 14, such that the tines 38 are resting against the vertical leg 20 of the body 14, and the rearward projection 42 rests on top of the upwardly-directed shoulder 40 of the body 14 (as seen in FIG. 1). The downwardly projecting leg 44 of the clip 16 remains at a slight forwardly-directed angle off of the vertical (as seen in FIGS. 8-10), since the leg 44 of the clip 16 is slightly offset from the imaginary vertical plane defined by the tines 38, as described above.

Figure 9:
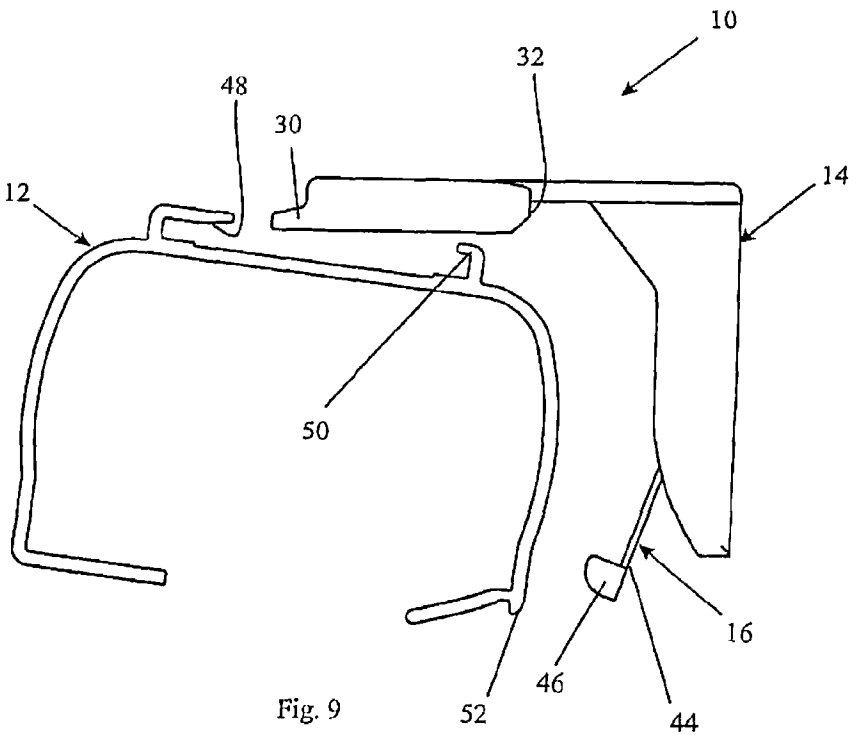
FIG. 9 is the same view as FIG. 8, but with the head rail shown removed from the mounting bracket and ready for installation.
Figure 8:
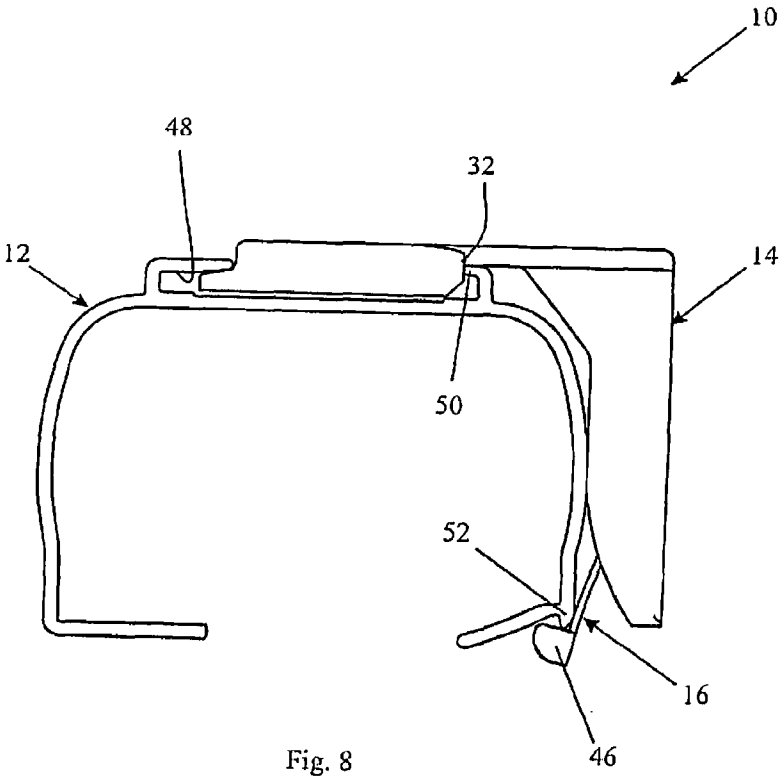
FIG. 8 is an end view of the head rail and mounting bracket of FIG. 1.
Figure 10:
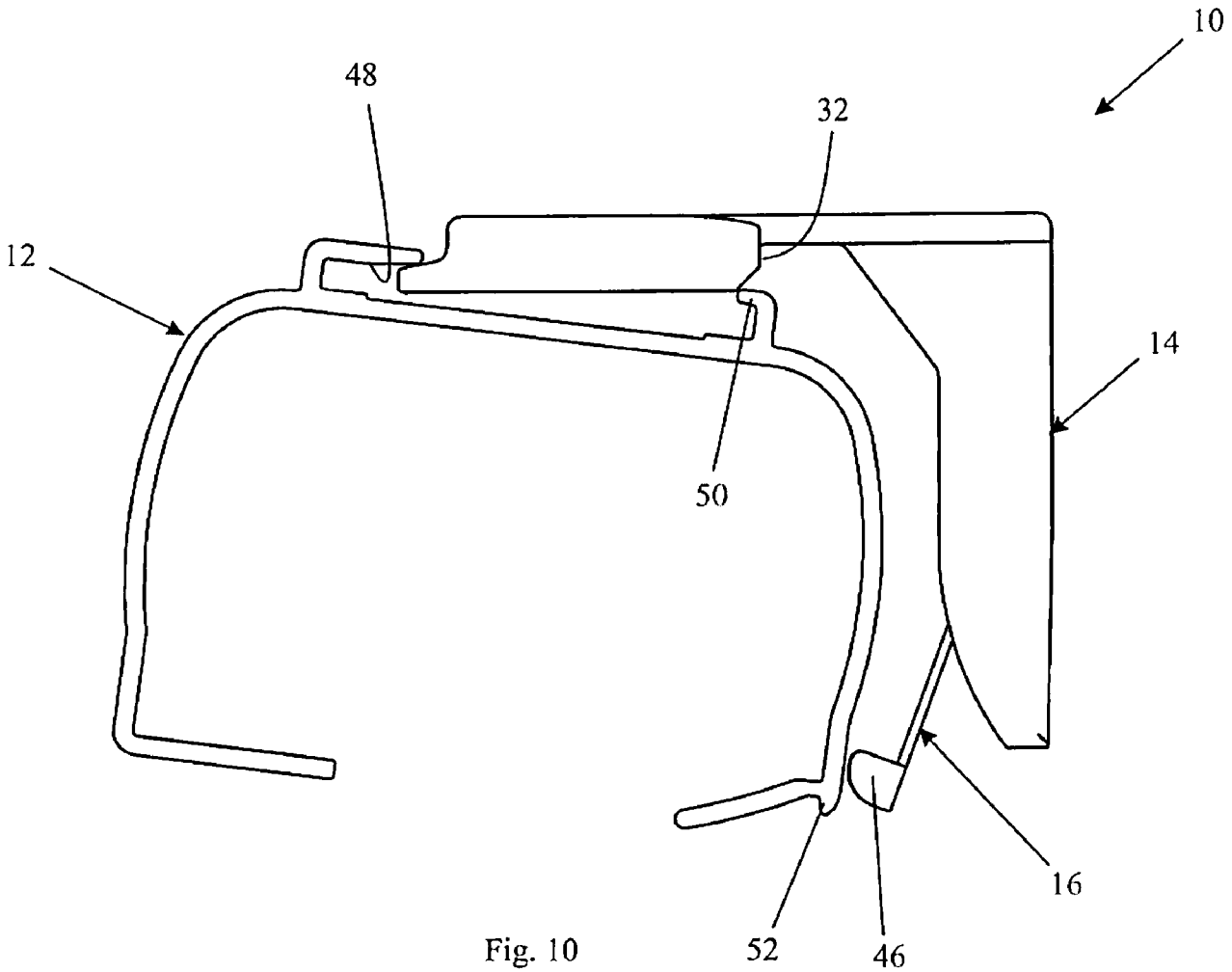
FIG. 10 is the same view as FIG. 9, but with the head rail shown partially mounted onto the mounting bracket.

FIGS. 8-10 show how the head rail 12 may be mounted onto the bracket 10. At this point, the bracket 10 is mounted onto a wall or other structure (not shown) using screws or other fasteners (not shown) extending through some of the through-holes in the bracket 10. Starting with FIG. 9, the "C" channel 48 on the head rail 12 is slid rearwardly to receive the lip 30 on the bracket 10 (See FIG. 10). The downwardly projecting leg 44 on the metal clip 16 is momentarily flexed back to make room for the head rail 12 to be pivoted up and back until the rear hook 50 on the head rail 12 engages the rear shoulder 32 on the bracket 10. The lower protruding edge 52 of the head rail 12 rides up along the ramped hooks 46 of the downwardly projecting leg 44 on the clip 16, pushing the leg 44 rearwardly. Once the lower protruding edge 52 of the head rail 12 passes the end of the hooks 46, the hooks 46 then snap back to support this lower protruding edge 52 and to lock the head rail 12 onto the bracket 10 (See FIG. 8).

In practice, it is not necessary to push back on the downwardly projecting leg 44 of the metal clip 16 in a separate action. Simply pushing up and back on the head rail 12 results in the downwardly projecting leg 44 being momentarily flexed back by the head rail 12 itself, until the rear hook 50 is latched onto the rear shoulder 32 and the lower protruding edge 52 of the head rail 12 has cleared the ramped hooks 46 of the bracket 12. The downwardly projecting leg 44 then snaps back to lock the head rail 12 onto the bracket 10.

Once the head rail 12 is mounted onto the bracket 10, the lower protruding edge 52 of the head rail 12 presses against the downwardly projecting leg 44 and hooks 46 of the metal clip 16, preventing forward motion of the downwardly projecting leg 44 and pushing the rearward projection 42 on the clip 16 downwardly in contact with the upwardly-directed shoulder 40 on the body 14. This shoulder 40 then acts as a stop to prevent the metal clip 16 from sliding downwardly off of the body 14 when the metal clip 16 is supporting the weight of the head rail 12 (and anything that is supported by the head rail, including the entire window covering). As long as the head rail 12 is mounted onto the bracket 10, it prevents the clip 16 from pivoting forward to release the rearward projection 42 from the shoulder 40, which prevents the tines 38 from sliding downwardly out of their slots. Thus, as long as the head rail 12 is mounted onto the bracket 10, it is not possible to remove the clip 16 from the body 14 without destroying either the plastic body part 14 or the metal clip 16 (or both).

To remove the head rail 12 from the bracket 10, the assembly process is simply reversed. The installer manually pushes back on the downwardly projecting leg 44 (or on the ramped hooks 46) of the metal clip 16 until the lower protruding edge 52 of the head rail 12 clears the ramped hooks 46. The head rail 12 may then be pivoted down and out until the rear hook 50 of the head rail 12 disengages from the rear shoulder 32 of the bracket 10. The head rail 12 may then be pulled out until the "C" channel 48 separates from the lip 30 of the bracket 10.

Figure 12:
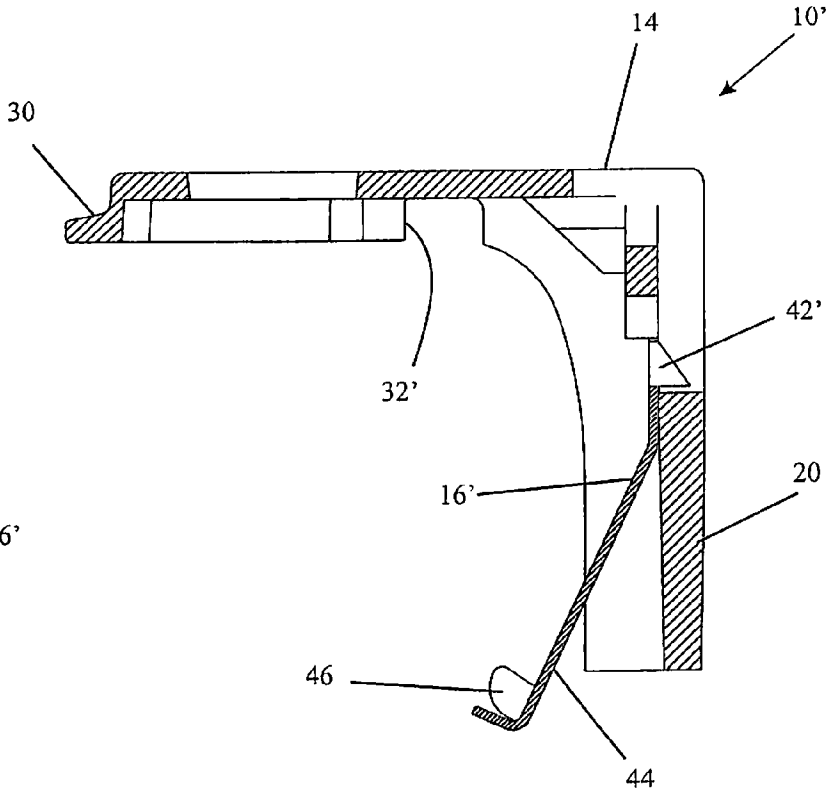
FIG. 12 is a sectional view along line 12-12 of FIG. 11.
Figure 11:
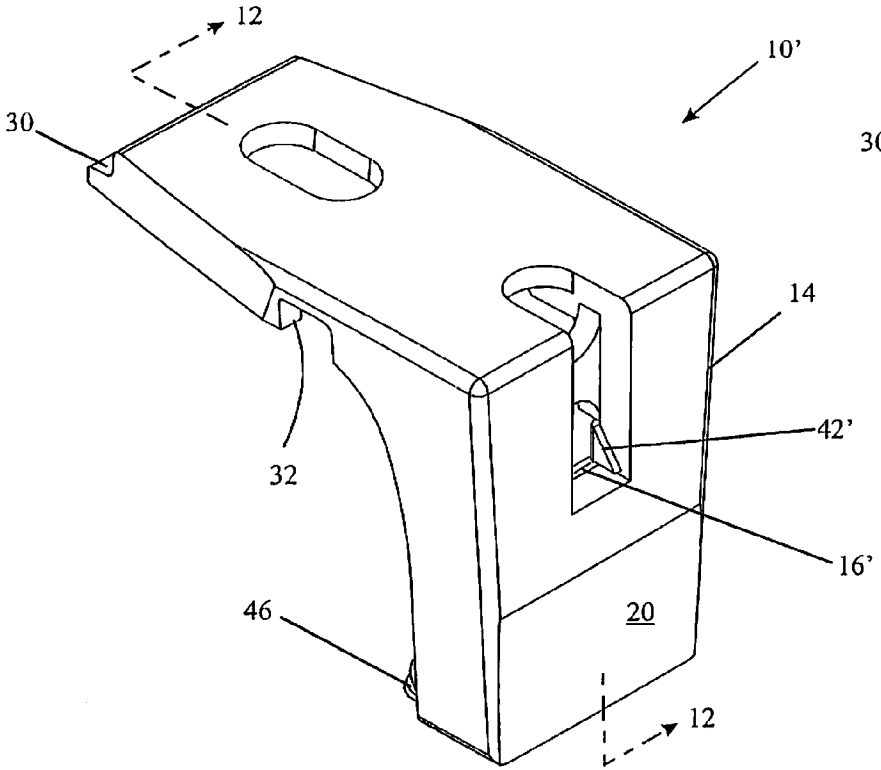
FIG. 11 is a perspective view of the mounting bracket of FIG. 1 but with a slightly different flexible metal piece.

FIGS. 11 and 12 depict a second embodiment of a mounting bracket 10', which utilizes the same plastic body 14 but a slightly different metal clip 16'. Instead of the single rearwardly-facing projection 42 on the previous metal clip 16 (see FIG. 5), this clip 16' has two, triangularly-shaped, rearwardly facing projections 42' having horizontal surfaces which engage the top of the upwardly-directed shoulder 40 on the vertical leg 20 of the body 14 when the metal clip 16' is assembled to the body 14, so as to prevent the clip 16' from falling out of the body 14.

Other than the slightly different metal clip 16', this mounting bracket 10' is essentially identical to the mounting bracket 10 described above, and operates in the same manner. Once the head rail 12 is assembled to the mounting bracket 10', the head rail 12 prevents the metal clip 16' from being disassembled from the housing 14 by preventing it from pivoting forwardly to release the projections 42' from the shoulder 40, which prevents the tines (not shown but identical to the previous embodiment) from sliding downwardly out of their slots. The ramped hooks 46 on the downwardly projecting leg 44 of the metal clip 16' engage and support the head rail 12 (in conjunction with the forwardly-projecting lip 30 of the housing 14) to keep it from falling.

FIGS. 13-20 depict another embodiment of a mounting bracket 10* made in accordance with the present invention. As in the case of the previous embodiments 10 and 10', the mounting bracket 10* includes a plastic housing 14* and a metal clip 16*.

Figure 14:
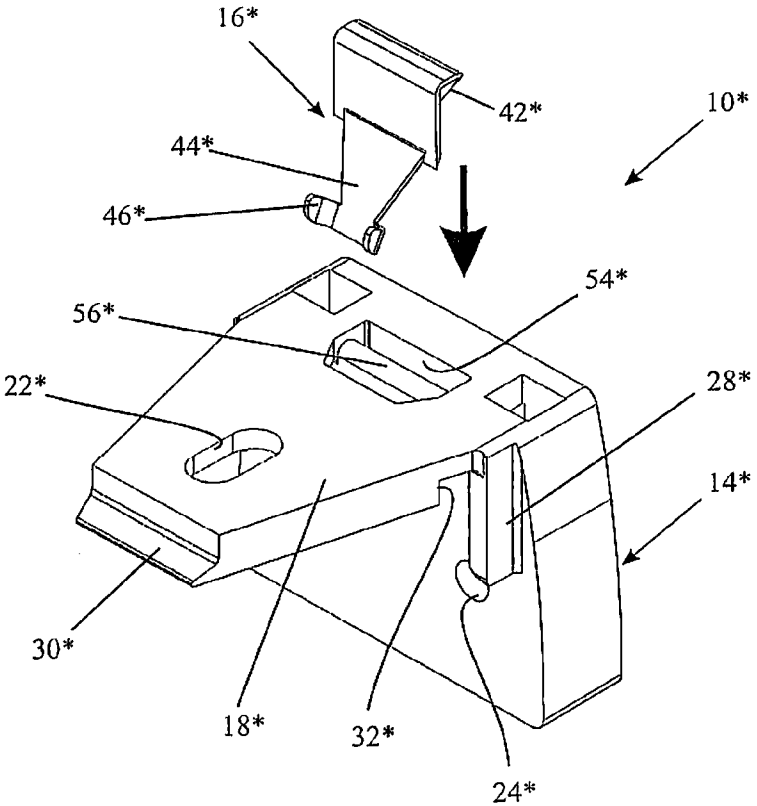
FIG. 14 is an exploded perspective view of the mounting bracket of FIG. 13.
Figure 13:
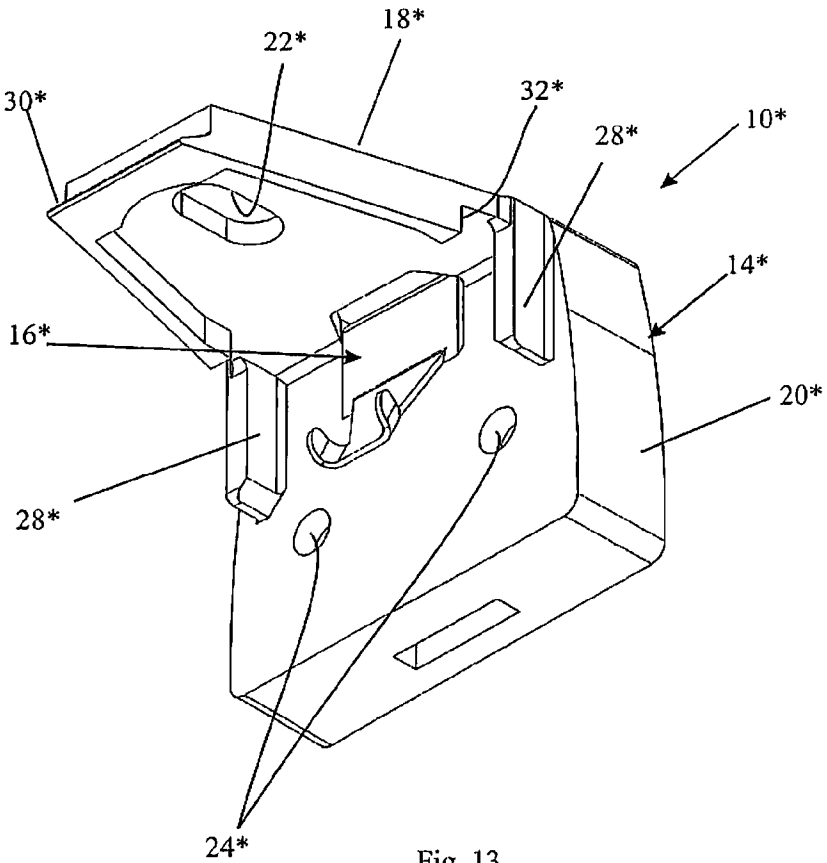
FIG. 13 is a perspective view of another embodiment of a mounting bracket made in accordance with the present invention.
Figure 17:
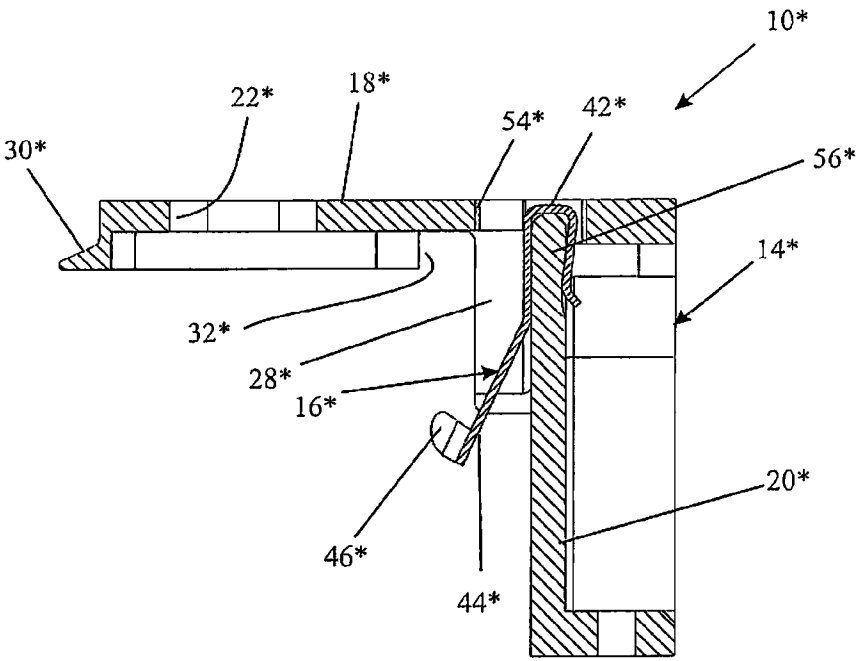
FIG. 17 is a section view along line 17-17 of FIG. 16.
Figure 16:
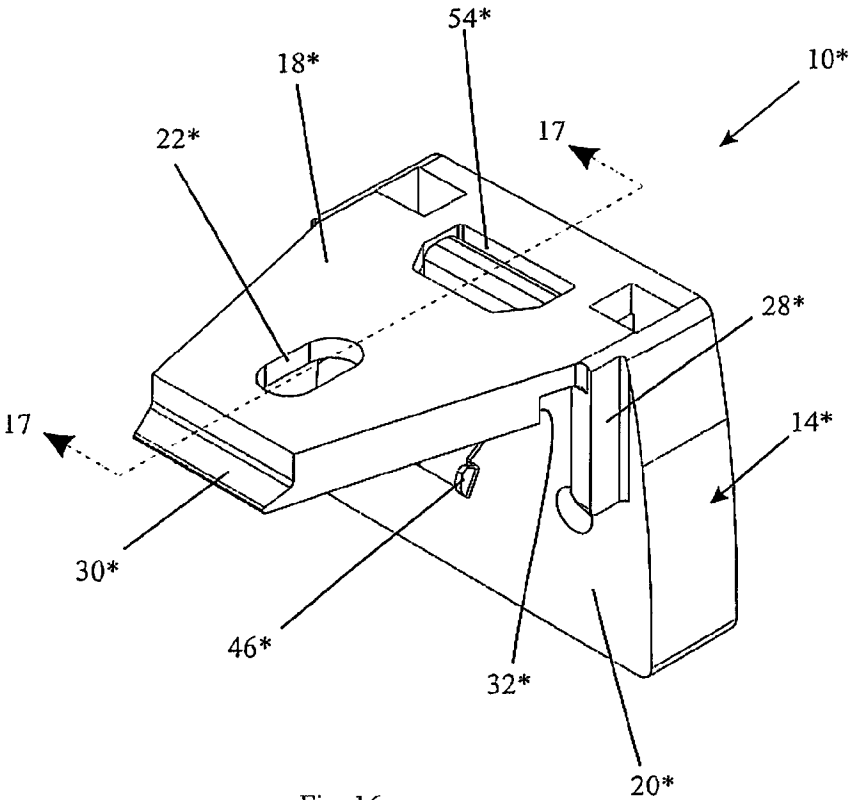
FIG. 16 is another perspective view of the mounting bracket of FIG. 13.

Referring to FIGS. 13, 14, and 17, the housing 14* is "L" shaped, with a horizontal leg 18* extending forwardly and a vertical leg 20* extending downwardly from the horizontal leg 18*. The horizontal leg 18* defines a through opening 22*, which may be used for securing the bracket 14* to a horizontal structure, using a screw, bolt, or other fastener (not shown). Similarly, the vertical leg 20* defines through openings 24*, which may be used for securing the bracket 14* to a vertical structure, using screws, bolts, or other fasteners (not shown). Gussets 28* on both sides of the bracket body 14* reinforce the connection between the horizontal and vertical legs 18*, 20* to make the body 14* strong and relatively inflexible.

The horizontal leg 18* also defines a forwardly-projecting lip 30* and a rearwardly-facing shoulder 32*, which are used to mount the head rail 12* (see FIGS. 18-20) to the bracket 10* in the same manner as was described for the previous embodiments 10, 10'.

The horizontal leg 18*, adjacent its intersection with the vertical leg 20*, defines a through slot 54* which exposes a portion of the upper edge 56* (see FIGS. 14 and 17) of the vertical leg 20*. This portion of the vertical leg 20* receives the rearwardly-extending hook 42* of the metal clip 16* as explained in more detail below. The upper edge 56* of the vertical leg 20* acts as a stop for the rearwardly facing hook 42* on the metal part 16* (See FIG. 17), to keep the clip 16* from falling once the clip 16* is assembled to the housing 14* as is explained in more detail below. The hook 42* thus extends horizontally rearwardly and then downwardly, wrapping around the upwardly-directed edge 56* of the vertical leg 20*.

Figure 15:
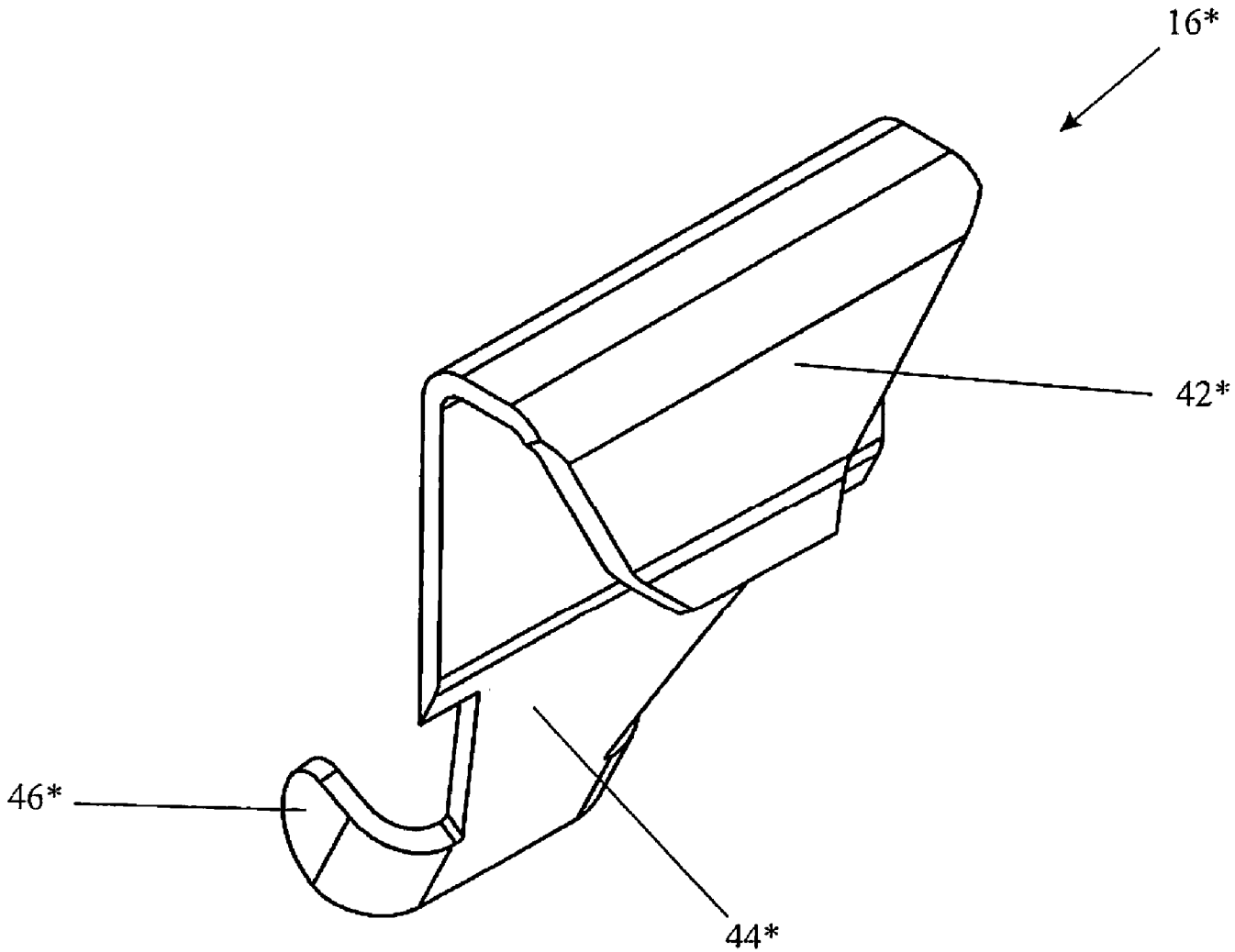
FIG. 15 is a perspective view of the flexible metal piece of the mounting bracket of FIG. 14.

Referring to FIG. 15, the metal flexible clip 16* is similarly shaped to the clip 16 (See FIG. 5) of the mounting bracket 10, including a downwardly projecting leg 44* which terminates in a pair of ramped hooks 46 which help secure the head rail 12 to the bracket 10* as described below. The upper portion of the metal clip 16* defines a rearwardly-extending hook 42* which, as described earlier, slides through the slot 54* in the horizontal let 18* of the housing 14* and hooks over the exposed upper edge 56* of the vertical leg 20* of the housing 14*, to keep the clips 16* attached to, and supported by, the housing 14*. The downwardly projecting leg 44* is angled forward from an imaginary plane defined by the hook 42*, as best illustrated in FIG. 17.

Referring to FIG. 14, the bracket 10* is assembled by sliding the clip 16* through the slotted opening 54* in the horizontal leg 18* of the housing 14* with the leg 44* of the clip 16* in front of the upper edge 56* and the hook 42* wrapping over the upper edge 56* of the vertical leg 20* of the housing 14*. The downwardly projecting leg 44* of the clip 16* remains at a slight forward angle off of the vertical (as seen in FIGS. 17-20) since the leg 44* of the clip 16* in its "at rest" position, is slightly offset at an angle that is forward and downward from the imaginary vertical plane defined by the hook 42*, as described earlier.

Figure 18:
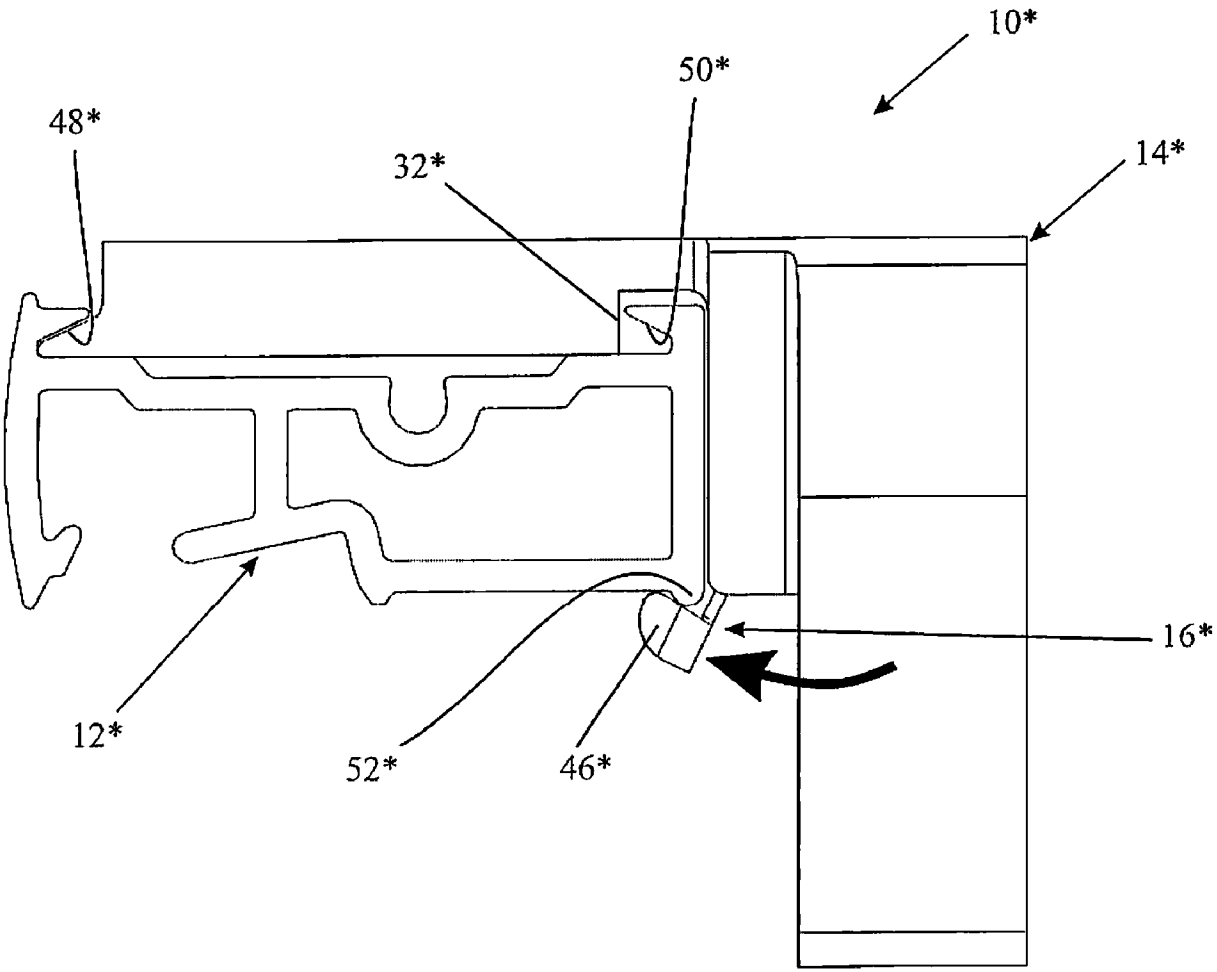
FIG. 18 is an end view, similar to that of FIG. 8, but for a head rail and the mounting bracket of FIG. 13.
Figure 19:
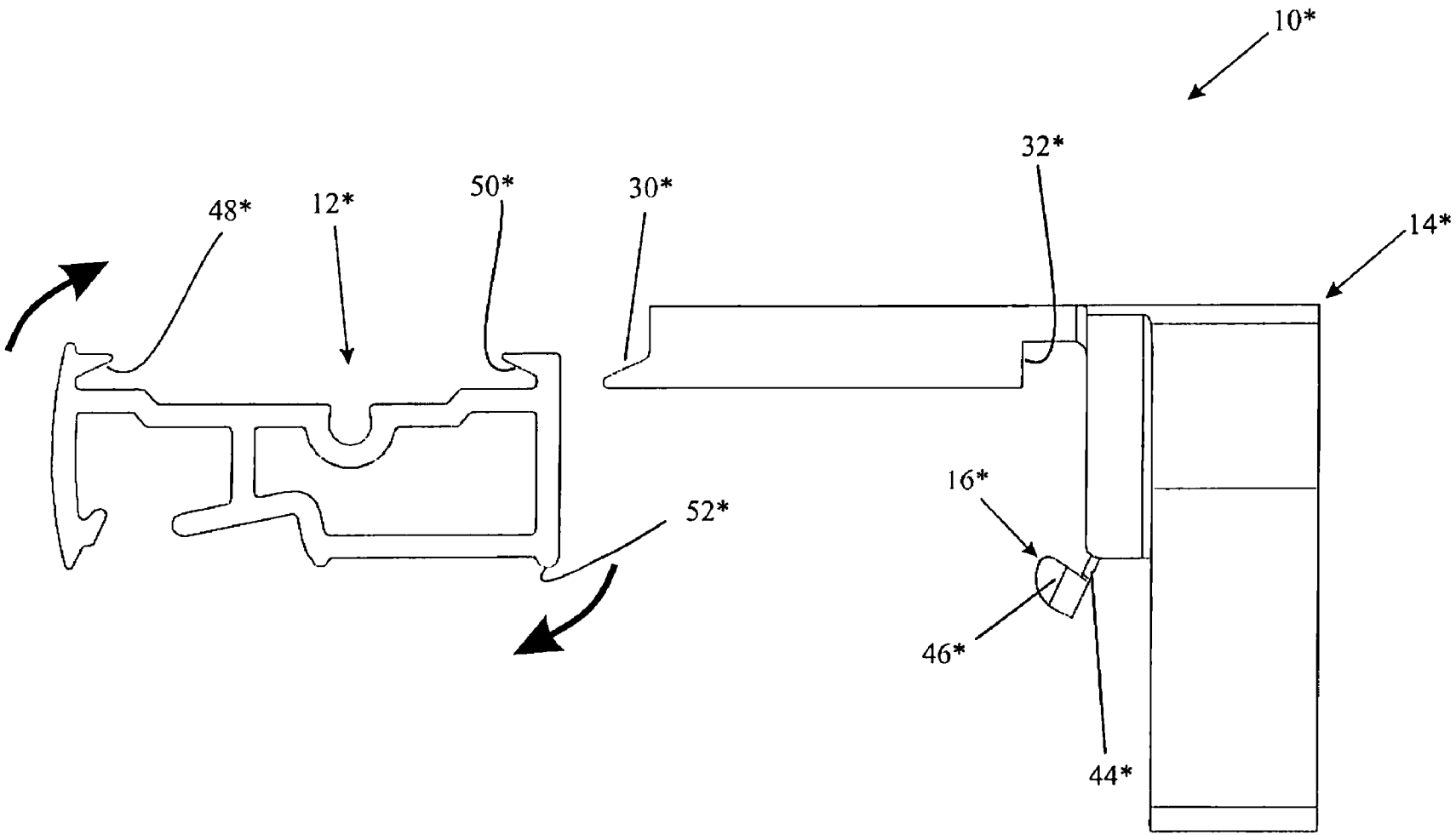
FIG. 19 is the same view as FIG. 18, but with the head rail shown removed from the mounting bracket and ready for installation.
Figure 20:
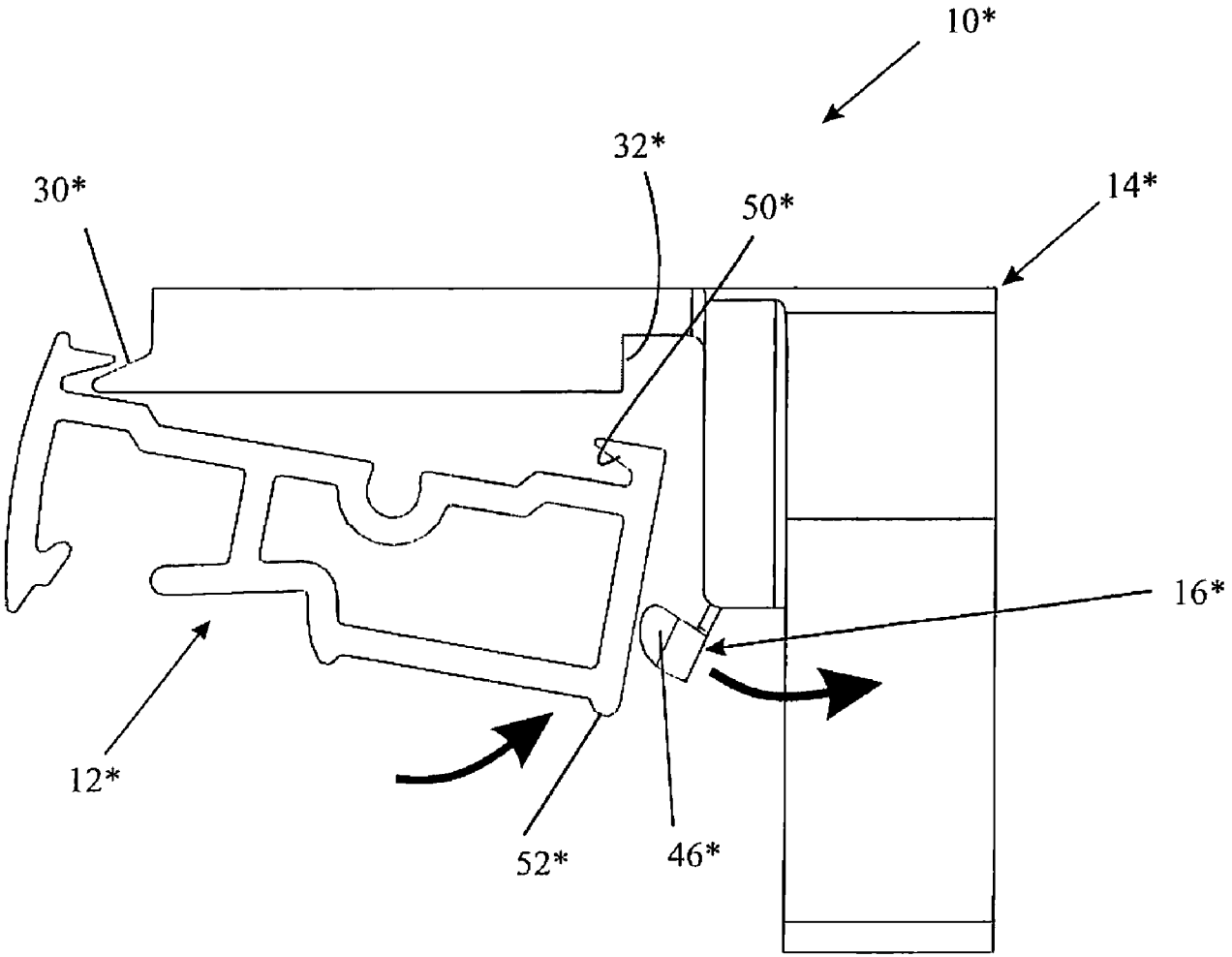
FIG. 20 is the same view as FIG. 19, but with the head rail shown partially mounted onto the mounting bracket.

FIGS. 18-20 show how a head rail 12* may be mounted onto the bracket 10*. At this point, the bracket 10* is mounted onto a wall or other structure (not shown) using screws or other fasteners (not shown) extending through some of the through-holes in the bracket 10*. Starting with FIG. 19, the "C" channel 48* on the head rail 12* is slid rearwardly to receive the lip 30* on the bracket 10* (See FIG. 20). The downwardly projecting leg 44* on the metal clip 16* is momentarily flexed back to its "flexed" position, in which it lies at an angle that is rearward and downward relative to its "at rest" position, in order to make room for the hear rail 12* to be pivoted up and back until the rear hook 50* on the head rail 12* engages the rear shoulder 32* on the bracket 10*. The lower protruding edge 52* of the head rail 12* rides up along the ramped hooks 46* of the downwardly projecting leg 44* on the clip 16*, pushing the leg 44* rearwardly and downwardly. Once the lower protruding edge 52* of the head rail 12* passes the end of the hooks 46*, the hooks 46* snap back to support this lower protruding edge 52* and to lock the head rail 12* onto the bracket 10* (See FIG. 18).

Once the head rail 12* is mounted onto the bracket 10*, the lower protruding edge 52* of the head rail 12* presses against the downwardly projecting leg 44* and hooks 46* of the metal clip 16*, preventing forward motion of the downwardly projecting leg 44* and pushing the rearwardly-extending hook 42* on the clip 16* downwardly in contact with the exposed upper edge 56* of the vertical leg 20* which acts as a stop to prevent the metal clip 16* from sliding downwardly off of the body 14* when the metal clip 16* is supporting the weight of the head rail 12* (and any of its contents including the entire window covering). While the head rail 12* is mounted onto the bracket 10*, it prevents the clip 16* from sliding up through the opening 54* to disassemble the clip 16* from the body 14*, so it is not possible to remove the clip 16* from the body 14* without destroying either the plastic body part 14* or the metal clip 16* (or both).

As in the case of the previously described embodiments 10, 10', to remove the head rail 12* from the bracket 10*, the assembly process is simply reversed. The installer pushes back on the downwardly projecting leg 44* (or on the ramped hooks 46*) of the metal clip 16* until the lower protruding edges 52* of the head rail 12* clears the ramped hooks 46*. The head rail 12* may then be pivoted down and out until the rear hook 50* of the head rail 12* disengages from the rear shoulder 32* of the bracket 10*. The head rail 12* may then be pulled out until the "C" channel 48* separates from the lip 30* of the bracket 10*.

Figure 22:
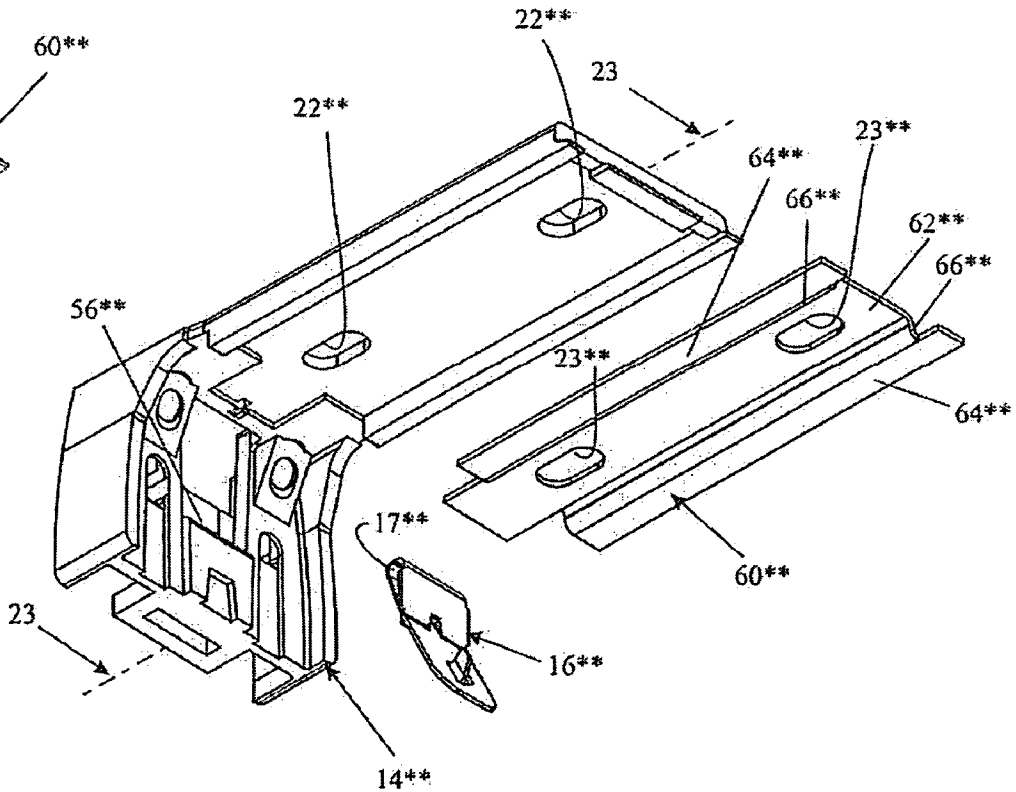
FIG. 22 is an exploded perspective view of the mounting bracket of FIG. 21.
Figure 21:
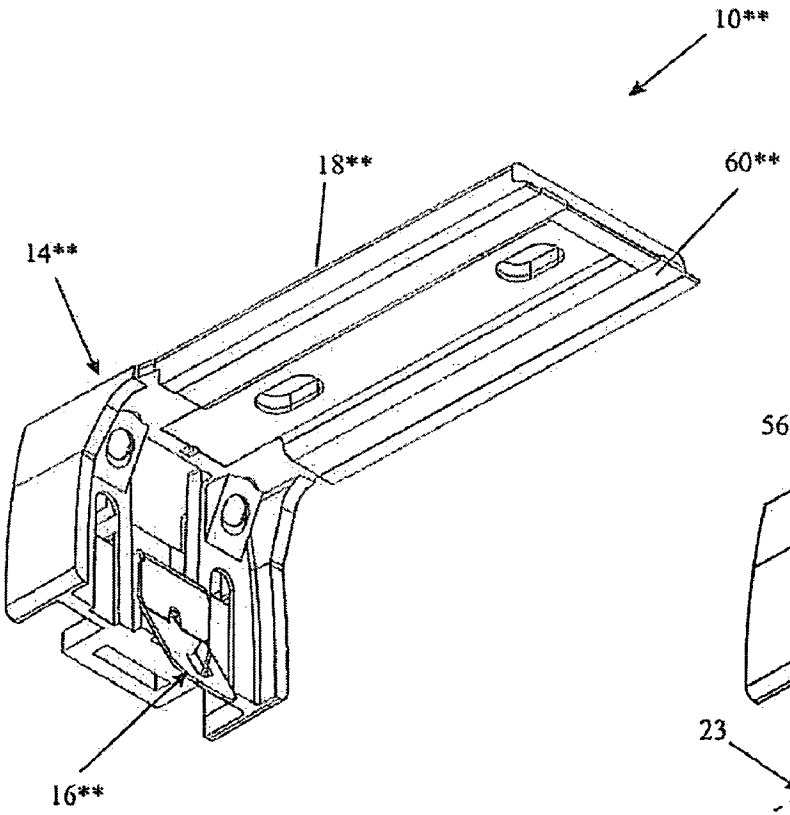
FIG. 21 is a perspective view of yet another embodiment of a mounting bracket made in accordance with this invention.
Figure 23:
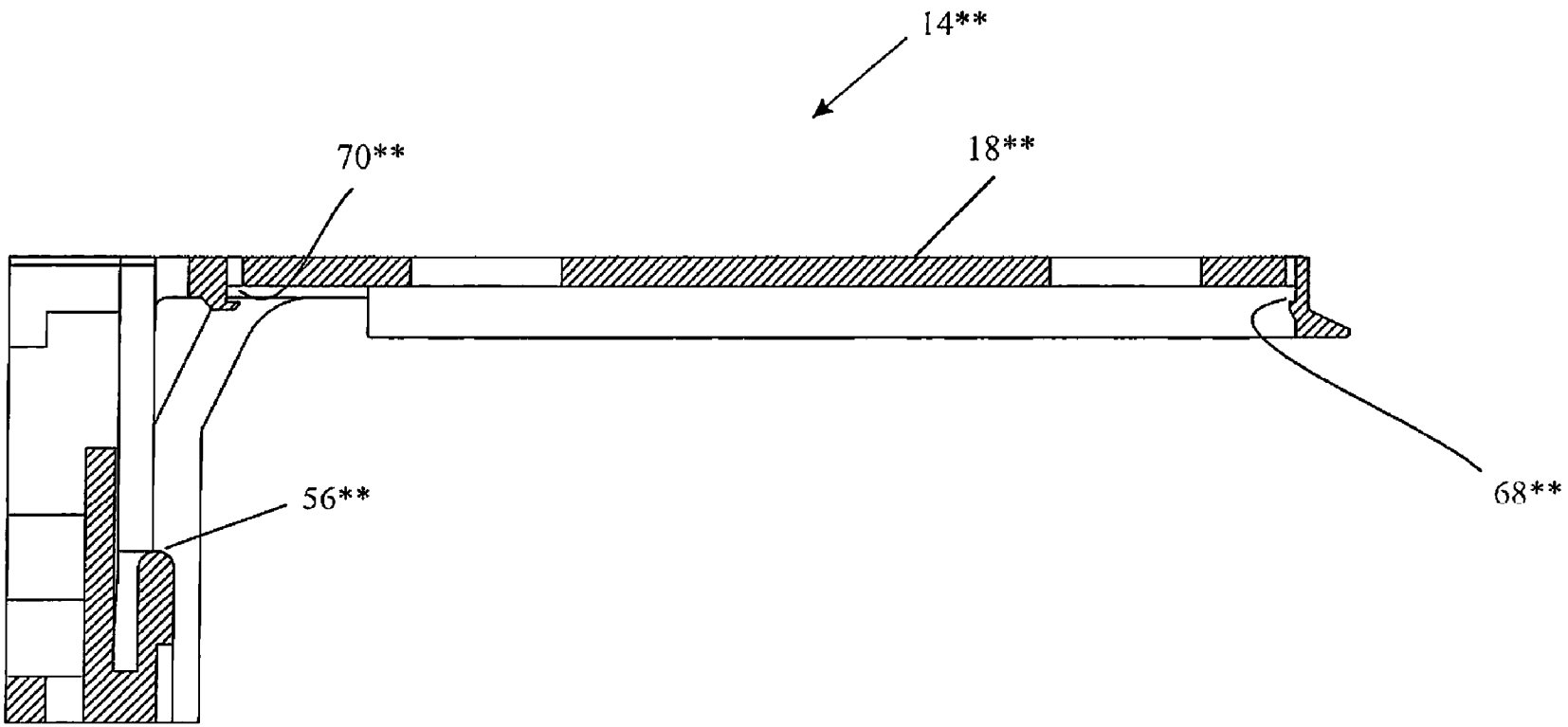
FIG. 23 is a section view along line 23-23 of FIG. 22.

FIGS. 21-23 depict yet another embodiment of a mounting bracket 10 made in accordance with the present invention. As in the case of the previous embodiments 10 and 10', the mounting bracket 10** includes a plastic housing 14** and a metal clip 16**. In addition, as best appreciated in FIG. 22, this mounting bracket 10** also includes a third piece, a steel insert 60** which is designed to increase the beam strength of the horizontal leg 18** of the plastic housing 14****, as described in more detail below.

Figure 25:
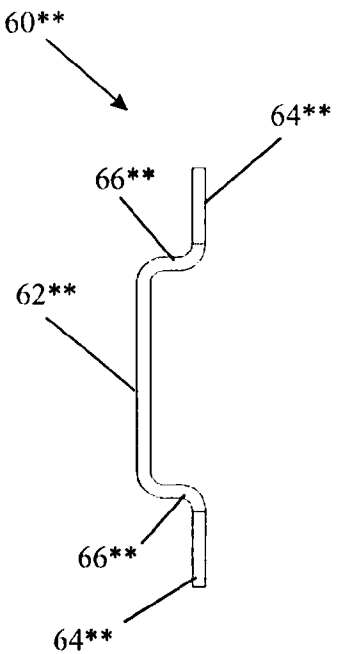
FIG. 25 is an end view of the metal insert of FIG. 22.
Figure 24:
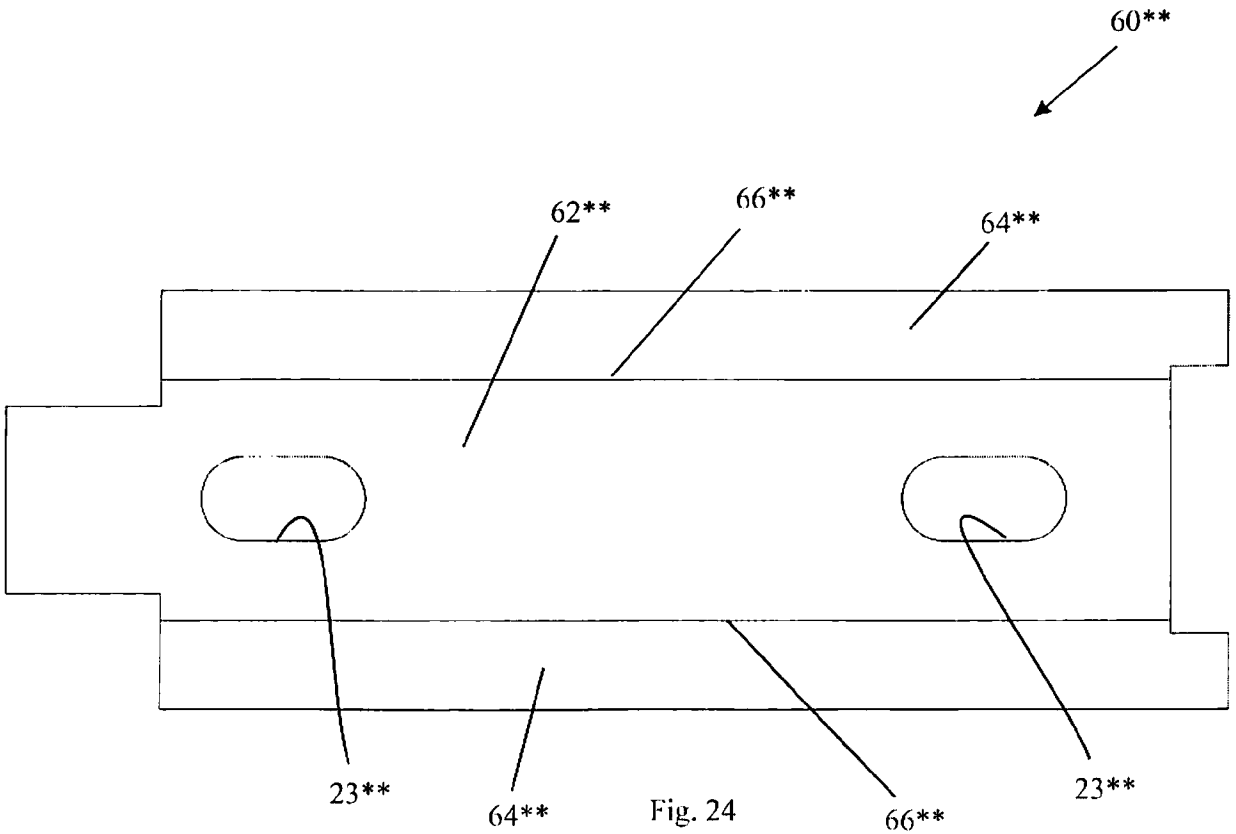
FIG. 24 is a plan view of the metal insert of FIG. 22.

As can also be appreciated in FIGS. 24 and 25, the steel insert 60 includes a flat central portion 62** which defines two oval-shaped through openings 23** which align with the corresponding openings 22** in the plastic housing 14**, as seen in FIG. 21. The steel insert 60** further includes two parallel linear flanges 64** which extend substantially the length of the steel insert 60**, and which are joined to the steel insert 60** via webs 66** which extend substantially perpendicular to the planes defined by the flat surfaces of both the flat portion 62** and the linear flanges 64**. This geometrical configuration (resembling a "hat" channel) of the steel insert 60** substantially contributes to the beam strength of the steel insert 60**, and therefore also of the mounting bracket 10**** once the parts are assembled as described below.

FIG. 23 is a sectional view of the plastic housing 14. The horizontal leg 18** of the housing 14** defines a front ledge 68** and a rear ledge 70** which receive the front and rear ends of the flat portion 62** of the steel insert 60**. The steel insert 60** may be assembled onto the housing 14** by pushing the rear edge of the insert 60** rearwardly on top of the rear ledge 70** and then pushing the front edge of the insert 60** upwardly so that it causes the front ledge 68** to flex outwardly until the front edge of the insert 60** passes the front ledge 68**. The front ledge 68** then snaps back to its original position, trapping the front edge of the insert 60** above the front leg 68**. This assembly may be done at the factory or in the field by the installer, and the insert 60** then remains in place and provides additional beam strength to the horizontal leg 18** of the mounting bracket 10**. The clip 16** assembles onto the housing 14** in a similar manner to the previous embodiment, with a rearwardly-directed hook on the clip 16** hooking over an upwardly directed shoulder 56** on the housing 14** (with the horizontal portion 17** of the clip 16** being supported on the upwardly directed shoulder 56**), a vertical portion of the clip 16** lying adjacent to the inner surface of the vertical leg of the housing 14**, and a lower portion of the clip 16** being angled in the forward and downward direction relative to the vertical leg of the housing 14**** and having a forwardly directed catch or hook at the bottom.

As was described with respect to the embodiment of FIG. 20, in order to assemble the head rail onto this bracket 10, the head rail is slid rearwardly to receive the front lip on the bracket 10**. Then the head rail is pivoted up and back until the rear hook on the head rail engages the rear shoulder on the bracket 10**. The lower portion of the head rail contacts the lower, angled portion of the clip 16** and causes it to flex to a "flexed" position, which is at an angle that is downward and rearward from its "at rest" position. Once the lower edge of the head rail passes the end of the hook on the angled portion of the clip 16**, the angled portion of the clip 16** snaps back to support the lower edge of the head rail and to lock the head rail onto the bracket 10****.

It will be obvious to those skilled in the art that modifications may be made to the embodiments described above without departing from the scope of the present invention.

What is claimed is:

1. A mounting bracket for mounting a head rail of a covering for architectural openings onto a surface, comprising:

a first substantially rigid L-shaped body defining an inner surface and an outer surface and including a horizontal leg and a vertical leg projecting downwardly from said horizontal leg, said horizontal leg defining a forward lip and a rearward shoulder for releasably securing the head rail to said body portion, said L-shaped body portion also defining an upwardly-directed shoulder; and a clip which is substantially more flexible than said L-shaped body, said clip having a horizontal portion supported on said upwardly-directed shoulder; and an angled portion having an "at rest" position in which it extends at an angle that is forward and downward relative to said vertical leg and having a "flexed" position in which it extends at an angle that is downward and rearward relative to its "at rest" position; said angled portion including a lower end having at least one forwardly-directed projection for receiving the bottom of the head rail.

2. A mounting bracket for mounting a head rail onto a surface as recited in claim 1, wherein the body portion is a plastic part and the clip portion is a metal part.

3. A mounting bracket for mounting a head rail onto a surface as recited in claim 2, wherein said clip also includes a vertical portion that lies adjacent to the inner surface of said vertical leg.

4. A mounting bracket for mounting a head rail onto a surface as recited in claim 3, wherein said vertical portion of said clip includes first and second vertical tines in the upper portion of said clip; and wherein said housing defines vertical slots which receive said tines.

5. A mounting bracket for mounting a head rail onto a surface as recited in claim 3, wherein said clip includes a hook which wraps around said upwardly directed shoulder, and wherein a portion of said hook is vertical.

6. A mounting bracket for mounting a head rail onto a surface, comprising:

a first substantially rigid L-shaped body defining an inner surface and an outer surface and including a horizontal leg and a vertical leg projecting downwardly from said horizontal leg, said horizontal leg defining a forward lip and a rearward shoulder for releasably securing the head rail to said body portion, said L-shaped body portion also defining an upwardly-directed shoulder; and a clip which is substantially more flexible than said L-shaped body, said clip having a horizontal portion supported on said upwardly-directed shoulder; an angled portion extending at a forward angle to said vertical leg; and a lower end having at least one forwardly-directed projection for receiving the bottom of the head rail, wherein the body portion is a plastic part and the clip portion is a metal part, and further comprising a beam-strengthening insert secured to the horizontal leg of said L-shaped body, said insert including at least one flat portion and one linear flange portion connected to said flat portion via a web.

7. A mounting bracket for mounting a head rail onto a surface as recited in claim 6, wherein said web lies along a plane which is substantially perpendicular to the plane defined by said flat portion of said insert.

* * * * *

UNITED STATES PATENT AND TRADEMARK OFFICE

CERTIFICATE OF CORRECTION

PATENT NO. : 7,367,536 B1
APPLICATION NO. : 11/468412
DATED : May 5, 2008
INVENTOR(S) : Richard N. Anderson et al.

It is certified that error appears in the above-identified patent and that said Letters Patent is hereby corrected as shown below:

Column 6, line 53, delete the word “hear” and insert therefor --head--.

Column 7, line 59, delete the word “leg” and insert therefor --ledge--.

Signed and Sealed this

Nineteenth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,367,536 B1
APPLICATION NO. : 11/468412
DATED : May 6, 2008
INVENTOR(S) : Richard N. Anderson et al.

It is certified that error appears in the above-identified patent and that said Letters Patent is hereby corrected as shown below:

Column 6, line 53, delete the word “hear” and insert therefor --head--.

Column 7, line 59, delete the word “leg” and insert therefor --ledge--.

This certificate supersedes the Certificate of Correction issued August 19, 2008.

Signed and Sealed this

Twenty-third Day of September, 2008

JON W. DUDAS
*Director of the United States Patent and Trademark Office*